United States Patent [19]

Svärd

[11] Patent Number: 4,667,606

[45] Date of Patent: May 26, 1987

[54] DEVICE AT INCINERATOR

[75] Inventor: Rune L. Svärd, Obbola, Sweden

[73] Assignee: Obbola Linerboard Aktiebolag, Obbola, Sweden

[21] Appl. No.: 862,218

[22] PCT Filed: Jul. 31, 1985

[86] PCT No.: PCT/SE85/00297

§ 371 Date: May 9, 1986

§ 102(e) Date: May 9, 1986

[87] PCT Pub. No.: WO86/01877

PCT Pub. Date: Mar. 27, 1986

[30] Foreign Application Priority Data

Sep. 17, 1984 [SE] Sweden ..... 8404656

[51] Int. Cl.[4] ..... F23K 3/14; F23K 3/16

[52] U.S. Cl. ..... 110/110; 110/287; 110/288; 414/158

[58] Field of Search ..... 110/110, 286, 287, 288; 414/150, 158

[56] References Cited

U.S. PATENT DOCUMENTS

| | | | |
|---|---|---|---|
| 691,328 | 1/1902 | Smead | 110/255 |
| 737,306 | 8/1903 | Wilson | 110/286 |
| 1,711,466 | 4/1929 | Turner | 110/110 |
| 2,365,679 | 12/1944 | Casey | 110/288 |
| 4,384,534 | 5/1983 | Lamb et al. | 110/288 X |

FOREIGN PATENT DOCUMENTS

| | | | |
|---|---|---|---|
| 125590 | 3/1900 | Fed. Rep. of Germany | 110/386 |
| 160759 | 5/1904 | Fed. Rep. of Germany | 110/110 |

*Primary Examiner*—Edward G. Favors

*Attorney, Agent, or Firm*—Burns, Doane, Swecker & Mathis

[57] ABSTRACT

The invention relates to a feed-in device for fuel in a fire-place with plane grate (5). The feed-in occurs through an opening (60) in the grate and comprises a tubular straight passageway (34), which extends upward from below to the opening (60), so that the center line of the passageway (34) forms an angle of 20°–45° to the surface of the grate (5) and that the opening (60) is displaced to the circumference of the grate (5).

15 Claims, 4 Drawing Figures

DEVICE AT INCINERATOR

This invention relates to a device at incinerators and, more precisely, to a feed-in device for fuel into such incinerator comprising a fire-place with plane grate. The device is particularly suitable for use at incinerators of cyclone type where fuel is fed-in through an opening in the grate.

At conventional devices of this kind the fuel is supplied from below through an angularly bent supply passageway and centrally in through the grate. Solid fuel, for example bark, shivers and chips, is hereby compressed which causes the fuel to get stuck. The conventional devices, moreover, yield an unfavourable fuel distribution on the grate and require much energy.

These problems are solved by the device according to the invention.

According to the invention, the feed-in device is designed as a tubular straight passageway, which extends upward from below to an opening in the grate, so that the centre line of the passageway forms an angle of 20°–45° to the grate surface. The opening is displaced from the centre to the circumference of the grate.

Further characterizing features of different embodiments of the invention are defined in the attached claims.

Figure 1:
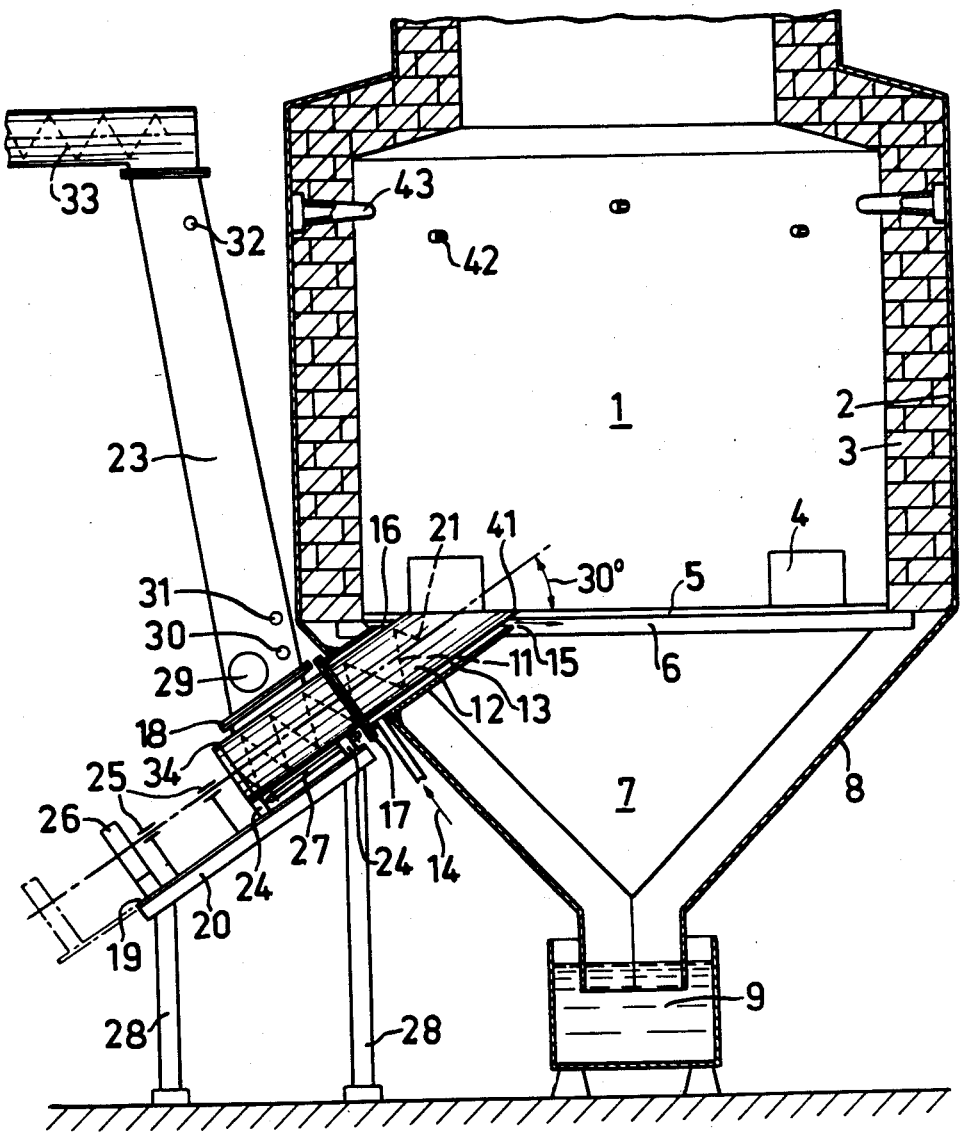
Figure 2:
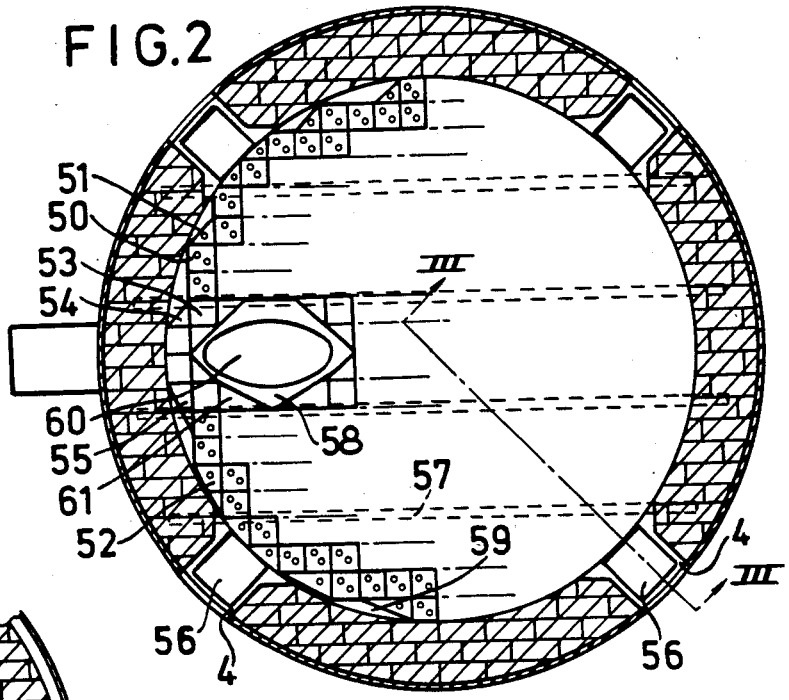
Figure 4:
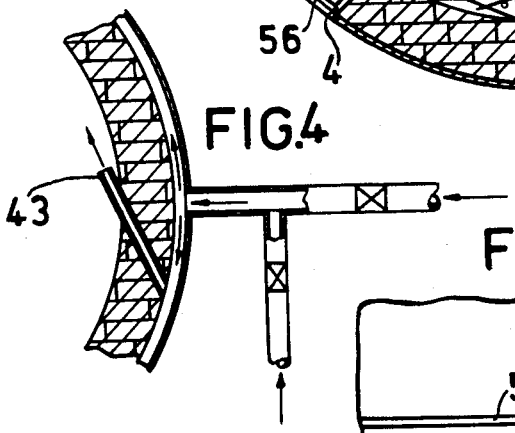
Figure 3:
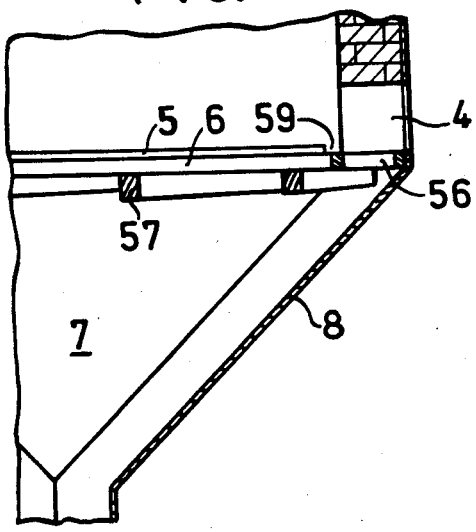

The invention is described in greater detail in the following by way of one embodiment thereof and with reference to the accompanying drawings, in which FIG. 1 is a cross-section of an incinerator with feed-in device, FIG. 2 is a view from above of the grate arrangement, FIG. 3 shows a detail of the slag outlet, and FIG. 4 shows a device for secondary air supply.

In FIG. 1 an incinerator 1 with a hearth jacket 2 and embedded protective bricks 3 is shown. The incinerator is provided with a plane grate 5, which is supported on beams 6. The ash space 7 is enclosed by a sheet metal casing 8 and directed downward to a trough 9 located beneath the inicinerator. The trough is filled with water, and the downward extension from the ash space terminates below the water surface in such a way as to act as a water seal. In said trough a conveyor screw or scraper (not shown) is mounted for ash removal. The fuel, which consists of bark or chips, is supplied by means of a screw 33 and through a slide 23 to the feed-in device positioned according to the invention.

In the incinerator wall, nozzles 42,43 from a distribution chamber are located, through which secondary air is supplied for combusting the material gasified on the grates of the fire-place. The nozzles are directed tangentially for bringing about a cyclone effect.

The feed-in device according to the invention comprises a tubular portion, which is rigidly mounted on the incinerator bottom and consists of an inner screw pipe 12 surrounded by a cooling jacket 13 with an inlet 14. Through a gap 15,16 between the cooling jacket and grate 5 that portion of the grate is cooled, which is located closest to the inlet of the feed-in pipe in the fire-place.

In straight extension of the rigidly mounted portion of the feed-in pipe, a movable portion 54 is provided, which is detachable from the rigidly mounted portion and mounted on a bottom plate 19 at the foundation 20. The fuel is charged into the incinerator by means of a screw 11, the thread pitch of which increases successively toward the inlet in the incinerator. The screw is supported in two positions 25 outside the feed-in pipe and, together with the movable portion 34 of the pipe, can be pulled out for cleaning and reconditioning. On said plate 19 also a hydraulic motor 26 for operating the screw is mounted. The movable portion 54 is provided with a cleaning door 27.

The grate plates, as shown in FIG. 2, to the greatest extent shall be square and of equal dimensions, in order to be easily exchangeable wherever in the grate surface they are located, and in order to reduce the manufacturing costs and to have to store in the spare parts stock only a small number of types.

The area closest to the inlet of the feed-in pipe in the grate surface is covered by grate plates without holes. The opening between grate plates and the feed-in pipe is covered by a loosely mounted ring, which is cooled by air from the feed-in pipe, which is provided with a cooling jacket. In the space between feed-in pipe and cooling jacket guide bars are inserted to counteract the cooling air and prevent it from "going the shortest way" upward beneath the grates and, respectively, between the feed-in pipe and the loosely mounted sealing ring.

Cooling of the feed-in pipe counteracts deformation by heat, which can occur in the case of fire beneath the grates (when fine-grained material has fallen down beneath the grates and been ignited), as well as in the case of down-firing for slagging when fuel can remain in the uppermost part of the feed-in pipe and glow. In order to counteract burning-off in the feed-in pipe, the grate plates closest to the feed-in pipe have no holes. By these blinded grates a small amount of fuel above and about the feed-in pipe can be "saved" in connection with down-firing for poking slag from grate plates provided with holes.

Openings 56 for slag removal are located at the lower edge of the lead-in 4 in the incinerator wall for slag doors. These openings are covered by doors, which are lifted out at slagging or can be provided with damper blades of various design. The ash space is formed so that the slag from the aforesaid openings is directed downward to a water-filled trough 9, which can be provided with a scraper conveyor for removing the slag to the container or the like. The connection between the "ash bin" and trough must be formed as a water seal, because the primary air beneath the grates produces over-pressure in the ash space.

In order to simplify the exchange of the fuel charge screw 11, the fuel feed-in pipe is assembled of two parts. For exchanging the screw, the bolt connections 17 and 18 are loosened, and the bottom plate 19 is loosened from the foundation 20. After the bottom plate has been displaced axially, the screw is swung to the side of the slide 23 and can then be lifted away together with what else is attached to the bottom plate 19.

At low load only one of the two rows of secondary air nozzles (FIG. 1) is used. Due to the high temperature, 800°–1000° C., prevailing in this part of the incinerator, at conventional incinerators the nozzles, which are not operative, often are exposed to high heat and deformed. For preventing this, at the incinerator according to the invention connection of cooling air is provided, which automatically is supplied when the secondary air nozzles are shut down (FIG. 4).

The invention is not restricted to the embodiment shown, but can be varied within the scope of the invention.

I claim:

1. A feed-in device for fuel in a fireplace with a plane grate in a cyclone type incinerator, wherein the feed-in device feeds the fuel through an opening in the grate, comprising a tubular straight passageway in the feed-in device extending upward from below the grate to said opening, the center line of the passageway forming an angle of 20°–45° to the grate, the opening displaced with respect to a circumference of the grate wherein the tubular straight passageway defines a rigid portion of the feed-in device and includes a conveyor screw in the passageway, a movable portion of the feed-in device connected to the rigid portion, and drive means and support means for driving and supporting the conveyor screw, said drive means and support means being movable together with the movable portion.

2. A device as defined in claim 1, wherein the tubular passageway comprises a conveyor screw with successively increasing pitch in the direction to the outlet in the incinerator.

3. A device as defined in claim 2, wherein the screw is supported in two positions outside the passageway.

4. A device as defined in claim 2, wherein the passageway comprises an outer jacket and an inner pipe, an inlet connected to the jacket so as to provide coolant thereto.

5. A device as defined in claim 1, wherein the fuel is supplied through a substantially vertical slide, which receives the fuel from a screw conveyor and is connected to the movable portion of the passageway by a flange.

6. A device as defined in claim 5, wherein the slide is provided with upper and lower level indicators.

7. A device as defined in claim 1, wherein the movable part of the passageway further includes a cleaning door.

8. A device as defined in claim 4, further comprising a gap located between the jacket and the grate a gap so as to provide a coolant for the grate.

9. A device as defined in claim 2, wherein the fuel is supplied through a substantially vertical slide, which receives the fuel from a screw conveyor and is connected to the movable portion of the passageway by a flange.

10. A device as defined in claim 3, wherein the fuel is supplied through a substantially vertical slide, which receives the fuel from a screw conveyor and is connected to the movable protion of the passageway by a flange.

11. A device as defined in claim 4, wherein the fuel is supplied through a substantially vertical slide, which receives the fuel from a screw conveyor and is connected to the movable portion of the passageway by a flange.

12. A device as defined in claim 9, wherein the slide is provided with upper and lower level indicators.

13. A device as defined in claim 10, wherein the slide is provided with upper and lower level indicators.

14. A device as defined in claim 11, wherein the slide is provided with upper and lower level indicators.

15. A device as defined in claim 4, wherein the movable part of the passageway further includes a cleaning door.

* * * * *